US008951001B2

(12) United States Patent
Lau et al.

(10) Patent No.: US 8,951,001 B2
(45) Date of Patent: Feb. 10, 2015

(54) HOSE ARRANGEMENT FOR STICK AND BUCKET OF MACHINE

(71) Applicants: Christopher Matthew Lau, New Berlin, WI (US); John Luvaas, Mequon, WI (US)

(72) Inventors: Christopher Matthew Lau, New Berlin, WI (US); John Luvaas, Mequon, WI (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 81 days.

(21) Appl. No.: 13/621,443

(22) Filed: Sep. 17, 2012

(65) Prior Publication Data

US 2014/0079521 A1 Mar. 20, 2014

(51) Int. Cl.

| | |
|---|---|
| ***E02F 3/00*** | (2006.01) |
| ***E02F 3/36*** | (2006.01) |
| ***E02F 3/30*** | (2006.01) |
| ***E02F 3/407*** | (2006.01) |
| ***E02F 9/22*** | (2006.01) |

(52) U.S. Cl.

CPC . *E02F 3/36* (2013.01); *E02F 3/308* (2013.01); *E02F 3/4075* (2013.01); *E02F 9/2275* (2013.01); *Y10S 37/903* (2013.01)

USPC ..... 414/723; 37/903

(58) Field of Classification Search

CPC ..... E02F 9/2275; E02F 9/2271; E02F 3/4075; E02F 3/404

USPC ..... 414/726, 723, 724, 727; 37/903, 406

See application file for complete search history.

(56) References Cited

U.S. PATENT DOCUMENTS

| | | | |
|---|---|---|---|
| 3,627,155 | A | 12/1971 | Van Der Zyl |
| 4,034,874 | A | 7/1977 | Collins |
| 4,270,286 | A | 6/1981 | Mieger |
| 2012/0171004 | A1 | 7/2012 | Jones, Jr. |

*Primary Examiner* — Gerald McClain

(74) *Attorney, Agent, or Firm* — Foley & Lardner LLP

(57) ABSTRACT

A machine includes a boom, a stick, a bucket, and a hose arrangement. The stick is pivotally coupled to the boom. The bucket is operatively coupled to the stick and defines a pivotal axis therein. The bucket has a bowl-shaped portion for holding material on a first side and a recessed portion on a second side. The hose arrangement is coupled to the bucket and includes a first and a second manifold, and a first and a second set of hoses. The first manifold is coupled to the bucket and disposed in the recessed portion proximal to the pivotal axis. The second manifold is coupled to the bucket and disposed on the second side of the bucket. The first set of hoses is fluidly connected to the first manifold. The second set of hoses is fluidly connected to the first and second manifolds.

18 Claims, 4 Drawing Sheets

HOSE ARRANGEMENT FOR STICK AND BUCKET OF MACHINE

TECHNICAL FIELD

The present disclosure relates to a hose arrangement, and more particularly to a hose arrangement for a stick and a bucket of a machine.

BACKGROUND

U.S Published Application 2012/0171004 relates to a material handling vehicle comprising a power unit, a work assembly coupled to the power unit, and a fluid supply system. The fluid supply system may comprise a pump structure for supplying a fluid, a first manifold apparatus located on the power unit, a second manifold apparatus located on the work assembly, and fluid supply line structure coupled between the first and second manifolds.

Conventional industrial machines may include hoses in arbitrary arrangements on components. This arbitrary arrangement of hoses may exhibit a disorganized or un-bundled form that may be difficult to locate and access. Further, the hoses may run directly from one manifold to another positioned on adjacent links present in the machine. During an operational mode of the machine, the links may move relative to each other. Subsequently, the associated hoses may get pulled or may sag based on the relative distance between the manifolds. Therefore, at this point, the hoses may become prone to getting caught by parts on a co-operating machine, such as a truck, or may get damaged by material falling on the hoses while the machine is in operation.

SUMMARY

In one aspect, the present disclosure provides a machine including a boom, a stick, a bucket, and a hose arrangement. The stick is pivotally coupled to the boom. The bucket is operatively coupled to the stick and defines a pivotal axis therein. The bucket has a bowl-shaped portion for holding material on a first side and a recessed portion on a second side. The hose arrangement is coupled to the bucket and includes a first and a second manifold, and a first and a second set of hoses. The first manifold is coupled to the bucket and disposed in the recessed portion proximal to the pivotal axis. The second manifold is coupled to the bucket and disposed on the second side of the bucket. The first set of hoses is fluidly connected to the first manifold. The second set of hoses is fluidly connected to the first and second manifolds.

In another aspect, the present disclosure provides a machine including a boom, a stick, a bucket, and a hose arrangement. The stick is pivotally coupled to the boom and includes a forked end having first and second arms. The bucket is operatively coupled to the stick and defines a pivotal axis therein. The hose arrangement is coupled to the bucket and includes a first and a second manifold, and a first and a second set of hoses. The first manifold is disposed between the first and second arms of the stick and coupled to the bucket such that the first manifold is disposed proximal to the pivotal axis. The second manifold is coupled to the bucket. The first set of hoses is fluidly connected to the first manifold. The second set of hoses is fluidly connected to the first and second manifolds.

Other features and aspects of this disclosure will be apparent from the following description and the accompanying drawings.

DETAILED DESCRIPTION

Figure 1:
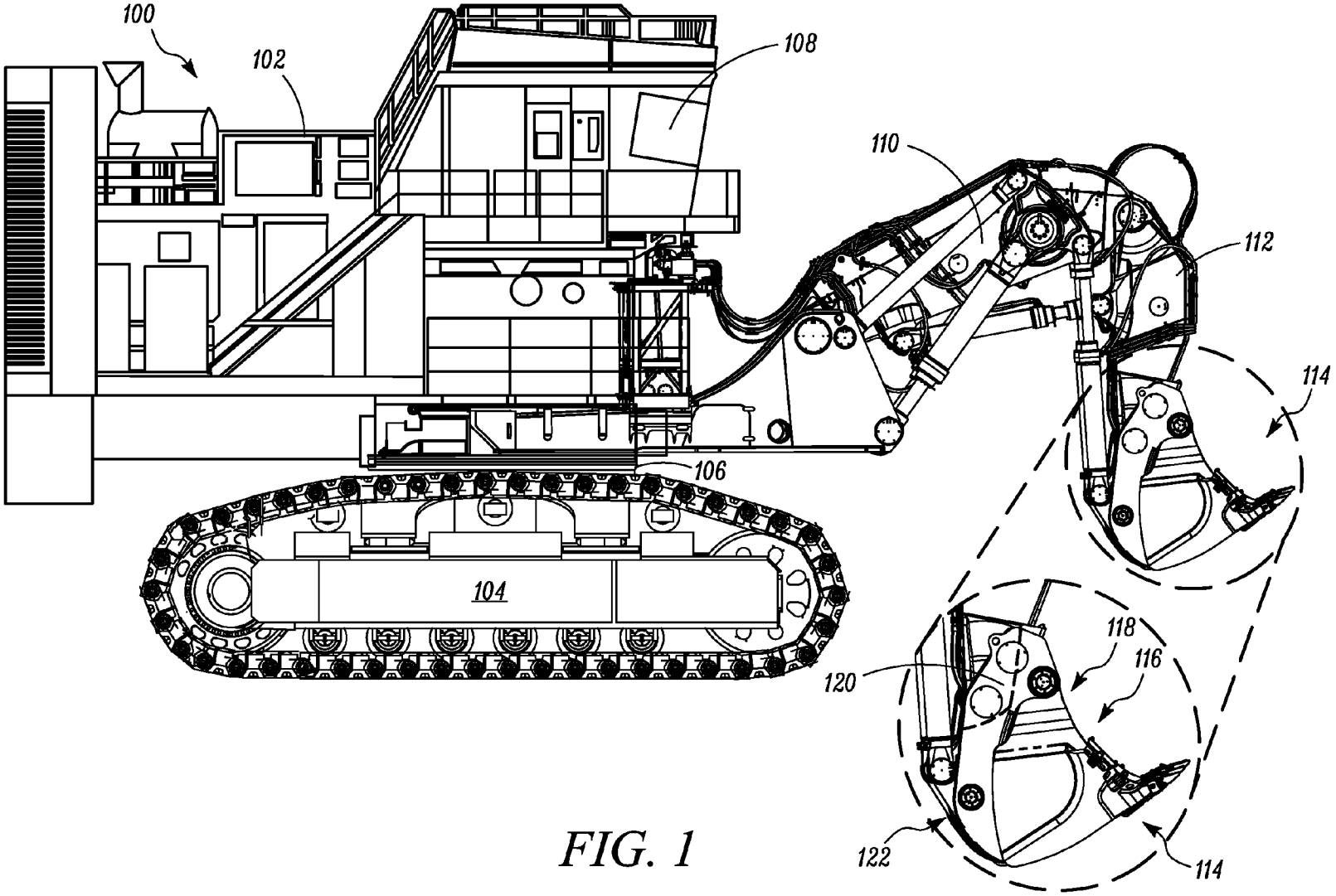
FIG. 1 is a side view of an exemplary machine in accordance with an embodiment of the present disclosure.

The present disclosure relates to a hose arrangement for a stick and a bucket of a machine. FIG. 1 illustrates a machine 100 in accordance with an embodiment of the present disclosure. The machine 100 may be a wheeled or tracked industrial vehicle, for example, but not limited to, a mining shovel, excavators, material loaders, dozers, and the like. In an embodiment, as shown in FIG. 1, the machine 100 may embody a tracked mining shovel used to load or unload material in mining and construction areas. The machine 100 includes a body 102 rotatable on a base 104 by a pedestal bearing 106. The machine 100 may also include a cab 108 positioned on the body 102 to accommodate an operator. As shown in FIG. 1, the machine 100 includes a boom 110, a stick 112, and a bucket 114. The stick 112 is pivotally coupled to the boom 110. In an embodiment, the bucket 114 defines a bowl-shaped portion 116 for holding material on a first side 118 and a recessed portion 120 (as shown by hidden lines) on a second side 122.

Figure 3:
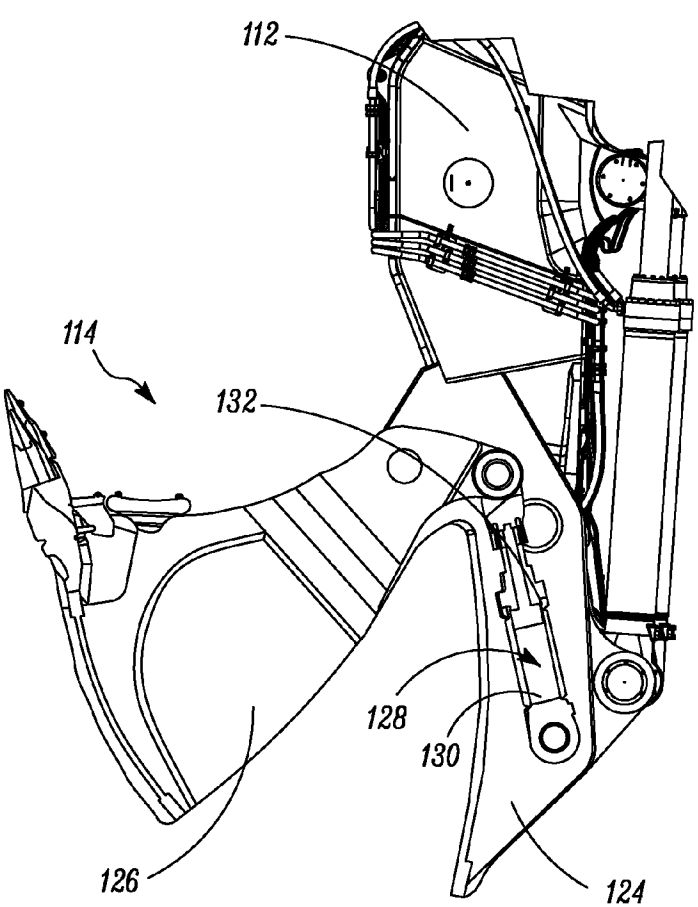
FIG. 3 is a left side view of the bucket.
Figure 2:
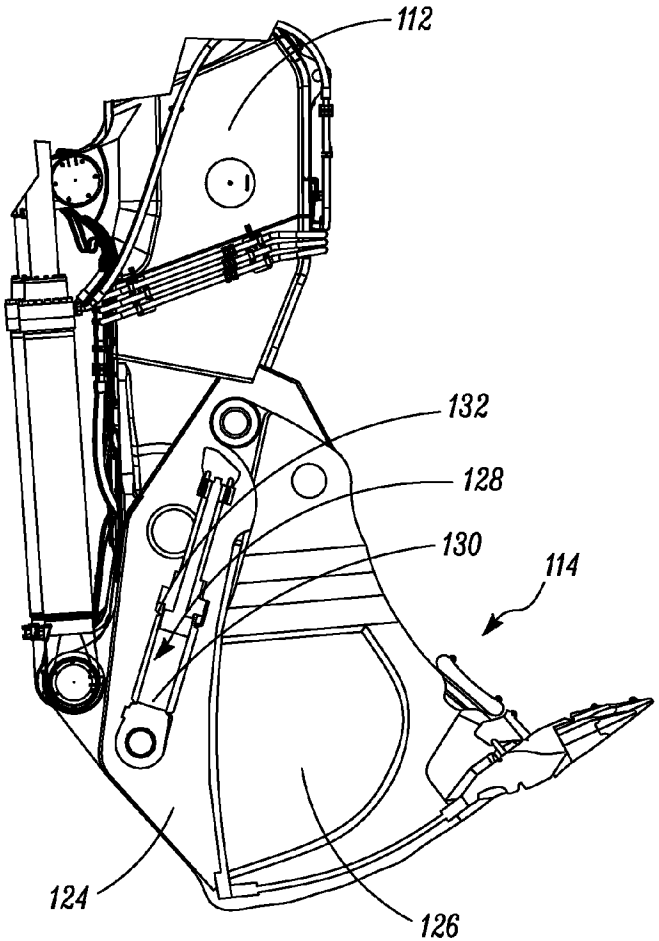
FIG. 2 is a right side view of a bucket of the machine.

As shown in FIGS. 2-3, the bucket 114 is pivotally coupled to the stick 112. In an embodiment, the bucket 114 includes a rear wall portion 124 and a clam 126. The rear wall portion 124 is pivotally coupled to the stick 112. The clam 126 is pivotally coupled to the rear wall portion 124. The machine 100 further includes a pair of hydraulic cylinders 128 that are configured to tilt the clam 126 with respect to the rear wall portion 124. Each of the hydraulic cylinders 128 includes a head end 130 and a rod end 132.

Figure 4:
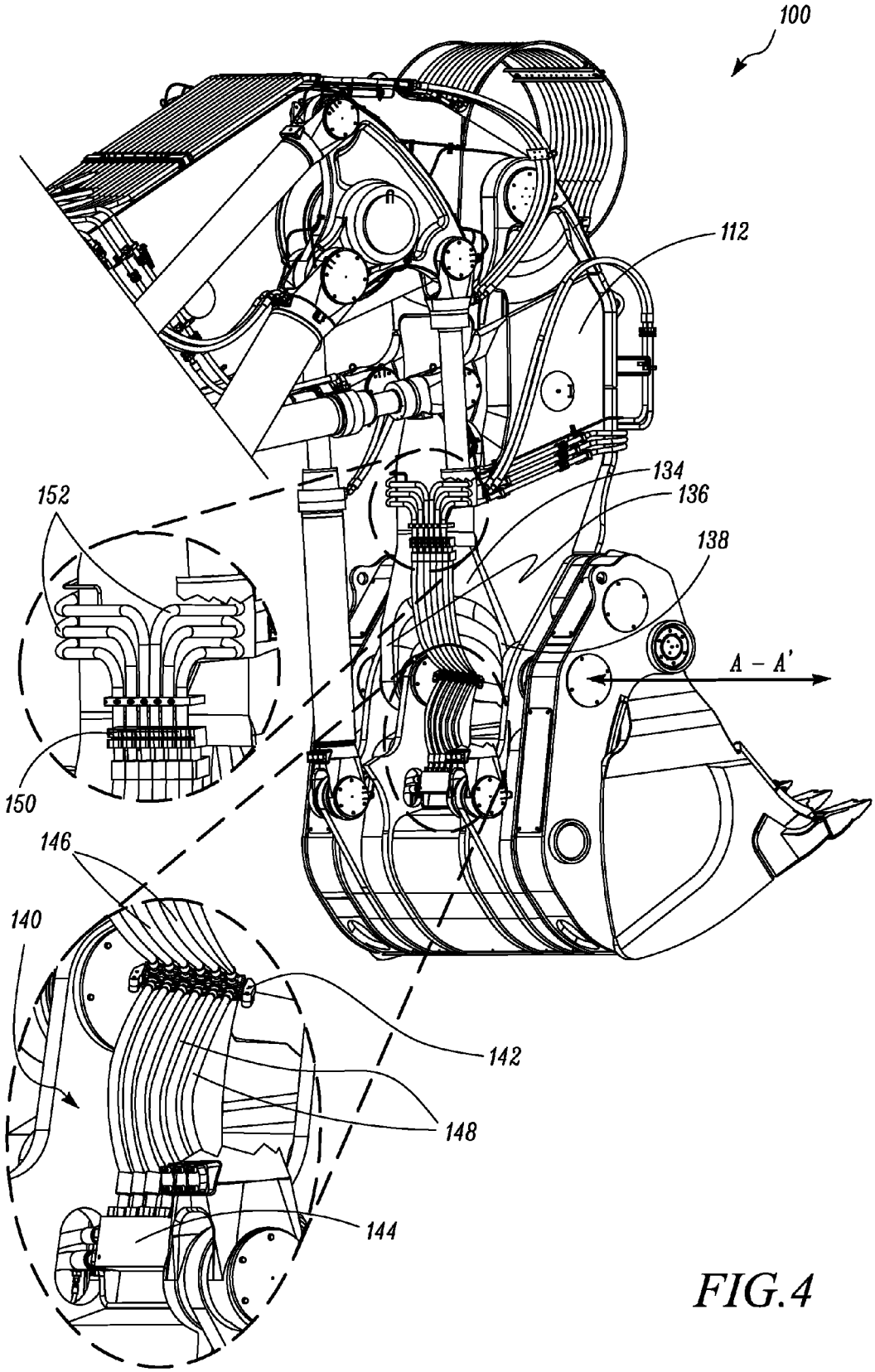
FIG. 4 is a breakaway perspective view of the machine illustrating a boom, a stick, the bucket, and a hose arrangement.

FIG. 4 illustrates a breakaway perspective view of the machine 100. The stick 112 includes a forked end 134 having first and second arms 136, 138. The bucket 114 is pivotally coupled to the first and second arms 136, 138 of the stick 112 and defines a pivotal axis A-A' therein. The machine 100 further includes a hose arrangement 140. It should be noted that the body 102 and the base 104 of the machine 100 have been eliminated in the view of FIG. 4 for the purposes of presenting an unobstructed angle of view to the hose arrangement 140 present therein. The hose arrangement 140 is coupled to the bucket 114. The hose arrangement 140 includes a first manifold 142, a second manifold 144, a first set of hoses 146, and a second set of hoses 148. In an embodiment, the machine 100 further includes a hose holder 150 coupled to the stick 112. The hose holder 150 may be configured to hold the first set of hoses 146. As shown in FIG. 4, these first set of hoses 146 may be threadedly engaged to tubes 152 that run from a reservoir (not shown) via a pump (not shown).

Figure 5:
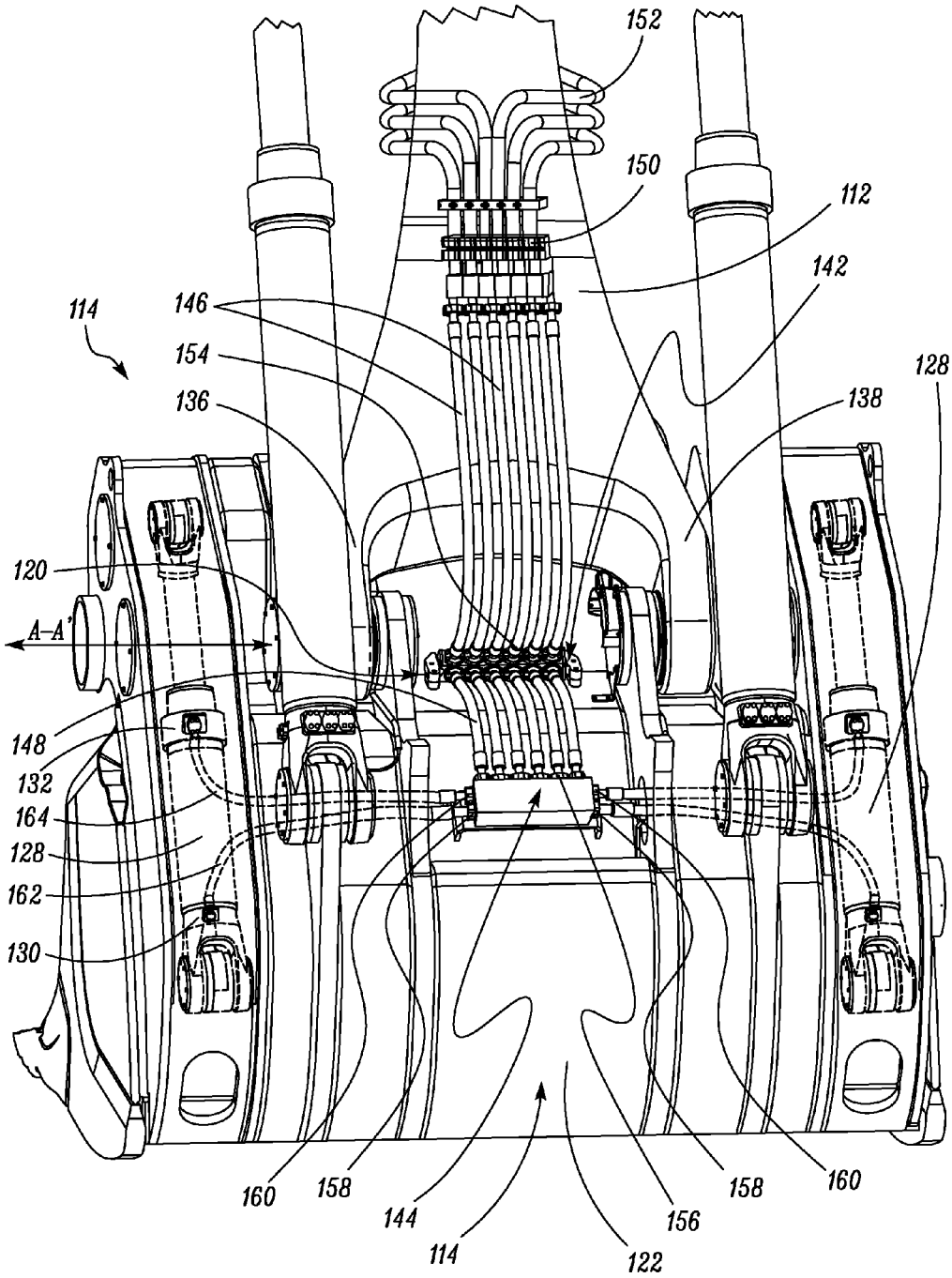
FIG. 5 is a rear perspective view of the bucket.

As can be seen from FIG. 5, the first manifold 142 is coupled to the bucket 114. The first manifold 142 is disposed between the first and second arms 136, 138 of the stick 112 and coupled to the bucket 114 such that the first manifold 142 is disposed proximal to the pivotal axis A-A'. In an embodiment, the first manifold 142 may be disposed in the recessed portion 120 at the second side 122 of the bucket 114. The second manifold 144 is coupled to the bucket 114. In an embodiment as shown in FIG. 5, the second manifold 144 may be disposed at the second side 122 of the bucket 114.

As shown in FIG. 5, the first set of hoses 146 is fluidly connected to the first manifold 142. In an embodiment, the first manifold 142 may include a first set of ports 154 in threaded engagement with the first set of hoses 146. The second set of hoses 148 is fluidly connected to the first and second manifolds 142, 144. In an embodiment, the first and second set of hoses 146, 148 is disposed along the second side 122 of the bucket 114. In an embodiment as shown in FIG. 5, the second manifold 144 may include a first set of ports 156, a second set of ports 158, and a third set of ports 160. In this embodiment, the first, the second, and the third set of ports 156, 158, and 160 may be disposed in threaded engagement with the second, a third, and a fourth set of hoses 148, 162, and 164 respectively. Further, the third set of hoses 162 may be disposed in fluid communication with the head end 130 of the hydraulic cylinders 128 while the fourth set of hoses 164 may be disposed in fluid communication with the rod end 132 of the hydraulic cylinders 128.

Although it is disclosed in preceding embodiments that a threaded engagement is used to connect the first set of hoses 146 to the first manifold 142, and the second set of hoses 148 to the first and second manifolds 142, 144, a person having ordinary skill in the art will acknowledge that the aforesaid connections may be accomplished by other methods commonly known in the art. Therefore, it is to be understood that the threaded engagement disclosed herein is only exemplary in nature and hence, does not limit the scope of this disclosure.

Further, as evident from the preceding disclosure to a person having ordinary skill in the art, the tubes 152, the manifolds 142, 144, and the various hoses 146, 148, 162, and 164 of the machine 100 may contain a fluid configured to actuate the hydraulic cylinders 128. The fluid may be drawn from the reservoir by the pump. The fluid may be pressurized by the pump and routed through the hoses 146, 148, 162, and 164 and the manifolds 142, 144. The fluid may be directed towards the head end 130 and the rod end 132 of the hydraulic cylinders 128 by the third set of hoses 162 and fourth set of hoses 164 respectively. A fluid entry at the rod end 132 of the hydraulic cylinders 128 may cause a compression stroke of the hydraulic cylinders 128 while a fluid entry at the head end 130 of the hydraulic cylinders 128 may cause an expansion stroke of the hydraulic cylinders 128. Subsequently, the compression and expansion of the hydraulic cylinders 128 may cause the clam 126 to tilt with respect to the rear wall portion 124.

Although it is disclosed herein that the hose arrangement 140 is coupled to at least one of the boom 110 and the stick 112 of the exemplary machine 100, it is evident from FIG. 1 that the hose arrangement 140 continues onto the boom 110 and the body 102 of the machine 100. Hence, a person having ordinary skill in the art may acknowledge that the hose arrangement 140 may be implemented to organize hoses at other linkages of the machine 100 and may not be limited to positions associated with the bucket 114 and/or the stick 112 of the machine 100. Therefore, it is to be noted that the embodiments disclosed herein are merely exemplary in nature and non-limiting of this disclosure.

INDUSTRIAL APPLICABILITY

Conventional industrial machines may include hoses in arbitrary arrangements on various components. This arbitrary arrangement of hoses may not exhibit an organized or bundled form that is easy to locate and access. Further, the hoses may run directly from one manifold to another positioned on adjacent links of the machine. During an operational mode of the machine, these links may move relative to each other causing the associated hoses to sag or undergo tensioning based on the relative distance between the manifolds on the moving links. Therefore, at this point, the hoses may become prone to getting caught by parts on a co-operating machine, such as a truck, or may get damaged by material falling on the hoses while the machine is in operation. A movement of the links thereupon may cause snapping of the hoses.

Typically, the hoses present in industrial machines contain fluid, generally oil. In an event of one or more hoses snapping, the oil may spill onto the ground leading to stoppage of the machine. Other consequences of such a spill may include wastage of oil, hazard to ground crew, and environmental concerns. Further, a snapping of such unorganized hoses may contribute to downtimes of the machine and require subsequent service or repair of the hoses. A person having ordinary skill in the art may acknowledge that the repair of hoses may decrease productivity of the machine and incur unnecessary expenditure.

Although it may not be readily apparent to one skilled in the art, the hose arrangement 140 disclosed herein is configured to closely follow a contour of the stick 112 and the bucket 114. Further, in a specific embodiment, the recessed portion 120 on the second side 122 of the bucket 114 may allow the first and second set of hoses 148, to be substantially tucked into the bucket 114 at its second side 122. This hose arrangement 140 may position the hoses substantially away from the co-operating machine 100 and the parts thereon thus making the hoses less susceptible to be caught and/or snapped. Therefore, implementation of the hose arrangement 140 in machines may make movement of links smoother. Further, implementation of the hose arrangement 140 may make overall handling of the machine 100 easier and may increase productivity associated with the machine 100.

While aspects of the present disclosure have been particularly shown and described with reference to the embodiments above, it will be understood by those skilled in the art that various additional embodiments may be contemplated by the modification of the disclosed machine, systems and methods without departing from the spirit and scope of what is disclosed. Such embodiments should be understood to fall within the scope of the present disclosure as determined based upon the claims and any equivalents thereof.

We claim:

1. A machine comprising:

a boom;

a stick pivotally coupled to the boom, the stick including a forked end having first and second arms;

a bucket operatively coupled to the first and second arms and defining a pivotal axis therein;

a hose arrangement coupled to the bucket, the hose arrangement including:

a first manifold disposed between the first and second arms of the stick and coupled to the bucket such that the first manifold is disposed proximal to the pivotal axis;

a second manifold coupled to the bucket;

a first set of hoses fluidly connected to the first manifold; and a second set of hoses fluidly connected to the first and second manifolds.

2. The machine of claim 1, wherein the machine is a mining bucket.

3. The machine of claim 1 further comprising a hose holder coupled to the stick, the hose holder configured to hold the first set of hoses.

4. The machine of claim 1, wherein the bucket defines a bowl-shaped portion for holding material on a first side and a recessed portion on a second side.

5. The machine of claim 4, wherein the first and second set of hoses is disposed along the second side of the bucket.

6. The machine of claim 4, wherein the first manifold is disposed in the recessed portion of the bucket.

7. The machine of claim 4, wherein the second manifold is disposed on the second side of the bucket.

8. The machine of claim 1, wherein the first manifold includes a first set of ports in threaded engagement with the first set of hoses.

9. The machine of claim 1, wherein the bucket includes:

a rear wall portion pivotally coupled to the stick;

a clam pivotally coupled to the rear wall portion; and a pair of hydraulic cylinders pivotally connected to the rear wall portion and the clam such that the hydraulic cylinders are configured to tilt the clam with respect to the rear wall portion, each of the hydraulic cylinders including a head end and a rod end.

10. The machine of claim 9, wherein the second manifold includes:

a first set of ports in threaded engagement with the second set of hoses;

a second set of ports in threaded engagement with a third set of hoses, the third set of hoses in fluid communication with the head end of the hydraulic cylinders; and a third set of ports in threaded engagement with a fourth set of hoses, the fourth set of hoses in fluid communication with the rod end of the hydraulic cylinders.

11. A machine comprising:

a body;

a boom;

a stick pivotally coupled to the boom, the stick including a forked end having first and second arms;

a bucket operatively coupled to the stick and defining a pivotal axis therein, the bucket having a bowl-shaped portion for holding material on a first side and a recessed portion on a second side; and a hose arrangement coupled to the bucket, boom and body, the hose arrangement including:

a first manifold coupled to the bucket, the first manifold being disposed in the recessed portion between the first and second arms and proximal to the pivotal axis;

a second manifold coupled to the bucket and disposed on the second side of the bucket;

a first set of hoses fluidly connected to the first manifold; and a second set of hoses fluidly connected to the first and second manifolds.

12. The machine of claim 1 further comprising a hose holder coupled to the stick, the hose holder configured to hold the first set of hoses.

13. The machine of claim 1, wherein the first and second set of hoses is disposed along the second side of the bucket.

14. The machine of claim 1, further comprising:

a first set of ports in threaded engagement with the first set of hoses; and a second set of ports in threaded engagement with the second set of hoses.

15. The machine of claim 1, wherein the bucket includes:

a rear wall portion pivotally coupled to the stick;

a clam pivotally coupled to the rear wall portion; and a pair of hydraulic cylinders pivotally connected to the rear wall portion and the clam such that the hydraulic cylinders are configured to tilt the clam with respect to the rear wall portion, each of the hydraulic cylinders including a head end and a rod end.

16. The machine of claim 15, wherein the rear wall portion is pivotally coupled to the first and second arms at the forked end of the stick.

17. The machine of claim 15, wherein the second manifold includes:

a first set of ports in threaded engagement with the second set of hoses;

a second set of ports in threaded engagement with a third set of hoses, the third set of hoses in fluid communication with the head end of the hydraulic cylinders; and a third set of ports in threaded engagement with a fourth set of hoses, the fourth set of hoses in fluid communication with the rod end of the hydraulic cylinders.

18. The machine of claim 1, wherein the machine is a mining shovel.

* * * * *